US005617017A

United States Patent [19]

Moyer

[11] Patent Number: 5,617,017

[45] Date of Patent: Apr. 1, 1997

[54] VOLTAGE REGULATOR HAVING MOS PULL-OFF TRANSISTOR FOR A BIPOLAR PASS TRANSISTOR

[75] Inventor: James C. Moyer, San Jose, Calif.

[73] Assignee: Micrel, Incorporated, San Jose, Calif.

[21] Appl. No.: 442,848

[22] Filed: May 17, 1995

[51] Int. Cl.[6] ..... G05F 3/20

[52] U.S. Cl. ..... 323/289

[58] Field of Search ..... 361/58, 86, 91, 361/111, 117, 119; 307/630–638, 643; 323/315

[56] References Cited

U.S. PATENT DOCUMENTS

| | | | |
|---|---|---|---|
| 4,868,703 | 9/1989 | Bozkowicz | 361/58 |
| 5,148,099 | 9/1992 | Ong | 323/314 |
| 5,149,988 | 9/1992 | Smith et al. | 307/296.6 |
| 5,373,228 | 12/1994 | Holle | 323/315 |

*Primary Examiner*—Aditya Krishnan
*Attorney, Agent, or Firm*—Skjerven, Morrill, MacPherson, Franklin & Friel; William L. Paradice, III

[57] ABSTRACT

An improved output driver is disclosed having a pull-off diode-connected transistor and a resistor for keeping a pass transistor off when no load current is desired. An MOS transistor is coupled in parallel with the pull-off diode. As the input voltage increases beyond a threshold level, the diode is no longer able to pull-off the pass transistor's base due to increasing leakage currents in the pass transistor and is thus unable to turn off the pass transistor. The MOS transistor turns on at this threshold voltage and pulls-off the pass transistor's base hard enough to keep the pass transistor off. In one embodiment, the MOS transistor is incorporated into an unadjusted field region of the diode-connected transistor without any additional masking or processing steps. Further, since it is formed in the field region of the diode, the inclusion of the MOS transistor requires no additional surface area.

17 Claims, 3 Drawing Sheets

VOLTAGE REGULATOR HAVING MOS PULL-OFF TRANSISTOR FOR A BIPOLAR PASS TRANSISTOR

FIELD OF THE INVENTION

The present invention relates to output transistors such as used in voltage regulators. More particularly, the present invention relates to an output circuit for a voltage regulator having increased stability at high voltages and high temperatures.

BACKGROUND OF THE INVENTION

Typically, voltage regulator circuits provide a constant output voltage of a predetermined value by monitoring the output and using feedback to keep the output constant. FIG. 1 shows an output driver 1 of a typical prior art voltage regulator. A PNP pass transistor 12 has its emitter coupled to an input voltage rail 14 and its collector coupled to an output terminal 16. Pass transistor 12 is typically a high power transistor. Voltages at rail 14 typically range from 5 to 30 volts.

A PNP transistor 18, operating as a current source, is connected to the collector of an NPN transistor 20. The collector of NPN transistor 20 is also coupled to the base of pass transistor 12.

NPN transistor 20 is controlled by a control signal coupled to its base 21 to turn on pass transistor 12 by pulling down the base of pass transistor 12. Diode 22, which is typically a diode-connected transistor, and resistor 24 are connected between the base of transistor 12 and voltage rail 14 to provide a pull-up voltage for the base of pass transistor 12.

Pass transistor 12 provides a variable current to output terminal 16 for driving a load (not shown) coupled between output terminal 16 and ground. The voltage at output terminal 16 is regulated by a feedback loop (not shown) which adjusts the control signal to the base 21 of NPN transistor 20. When the load requires a large current, the feedback circuit increases the control voltage to transistor 20 which, in turn, increases the conductance of pass transistor 12 to provide the necessary collector current to drive the load at output terminal 16. Conversely, when the load requires only a small amount of current, a lower control signal is generated by the feedback circuit so that pass transistor 12 provides only a small amount of current to output terminal 16. When no load current is desired, the control signal turns off transistor 20. However, when a small load current or no load current is intended to flow, relatively small base-substrate and base-emitter leakage currents within pass transistor 12, as well as similar leakage currents in transistor 20, result in unwanted additional current flowing through the base of pass transistor 12. This undesirable base drive current further turns on transistor 12 to some extent, causing a larger load current to be provided at output terminal 16 than was intended.

The amplification (or beta) of pass transistor 12 is problematic for another reason. At low base currents the beta of pass transistor 12 is higher than at larger base currents. Since the impedance looking into a transistor's base is proportional to its beta, it follows that the pass transistor's base impedance will also increase at low base currents. This larger base impedance, together with parasitic base-substrate and base-emitter capacitances of pass transistor 12, forms a low pass filter at the base of transistor 12. This low pass filter adds an additional pole to the regulator circuit, thereby limiting the frequency response of the circuit and causing unwanted oscillations at the output terminal 16.

The above-described problems are largely overcome by diode 22 and resistor 24. First, by providing a relatively low impedance path between the base and emitter of pass transistor 12, diode 22 and resistor 24 dominate the base impedance of pass transistor 12 at low base currents. The resultant decrease in base impedance mitigates the effects of the low pass filter, thereby improving the frequency response of the circuit and reducing the likelihood of oscillations.

As mentioned earlier, when no load current is to be provided, transistor 20 and pass transistor 12 should be in their off states. When transistor 20 is in its off or low conductivity state, the current through diode 22 and resistor 24 pulls up (i.e., pulls to a higher voltage) the base of transistor 12 to a high enough voltage to force transistor 12 to turn off despite the above-described leakage currents. In this manner, diode 22 and resistor 24 offset the tendency of leakage currents to turn on transistor 12 when no or little load current is to be provided to the load. Thus, by offsetting the base drive current of transistor 12, diode 22 and resistor 24 prevent undesirably large DC bias currents from flowing when little or no load current is desired.

At high input voltages and high temperatures, however, diode 22 and resistor 24 cease to operate properly in keeping transistor 12 turned off when no load current is to be provided. As the input voltage and/or the operating temperature increases, pass transistor 12's base-substrate and base-emitter leakage currents rapidly increase to levels sufficient to turn on transistor 12. As the input voltage exceeds approximately 40 volts, pass transistor 12 begins to experience punch-through, which causes a large collector current to flow. This large collector current causes the collector (or output) voltage to increase beyond its regulated level. This higher collector voltage, in turn, further increases the undesirable base drive discussed above. Diode 22 is no longer able to pull-off the base of transistor 12 hard enough or quickly enough to offset the strong base drive current resulting from the leakage currents. As a result, at such high temperatures and input voltages pass transistor 12 will supply a large collector current to the load. Such a large collector current, as discussed above, is problematic when the load requires no current or a small current.

Thus, there is a need for an improved output driver which reduces its associated pass transistor's base impedance at high input voltages and temperatures. There is also a need for an output driver which has the capability of pulling-off (i.e., turning off) its associated pass transistor at high temperature and high input voltage without any increase in ground current when the pass transistor is off.

SUMMARY OF THE INVENTION

An improved output driver is disclosed which overcomes problems in the art mentioned above. An MOS transistor is placed in parallel with a pull-off diode to drive current through a pull-off resistor at high temperature and high input voltages. As described above, as the input voltage level of a regulator circuit increases, leakage currents in the pass transistor become sufficient to offset the pull-off diode and drive the pass transistor into an on state. Without the MOS transistor, a large resultant collector current would drive more current into the load than intended. The MOS transistor automatically turns on when the input voltage increases and conducts sufficient current through the pull-off resistor to keep the pass transistor turned off. In keeping the pass transistor off at high temperatures and voltages, the MOS transistor thus ensures that large collector currents will not flow when a small current or no current is to be provided to a connected load. Further, by taking over for the pull-off diode, the MOS transistor maintains the pass transistor's reduced base impedance at low load currents, thereby preventing unwanted oscillations at high temperatures and input voltages.

In one embodiment, the MOS transistor is incorporated into an unadjusted field region of the diode. In this manner, fabrication of the MOS transistor does not require any additional semiconductor surface area. Further, no additional masking or processing steps are required. In this manner, the present embodiment can be implemented at a minimal cost without wasting valuable wafer space.

BRIEF DESCRIPTION OF THE DRAWINGS

These and other features, aspects, and advantages of the present invention will become better understood with regard to the following description, appended claims, and drawings where:

DETAILED DESCRIPTION OF THE PREFERRED EMBODIMENTS

Figure 1:
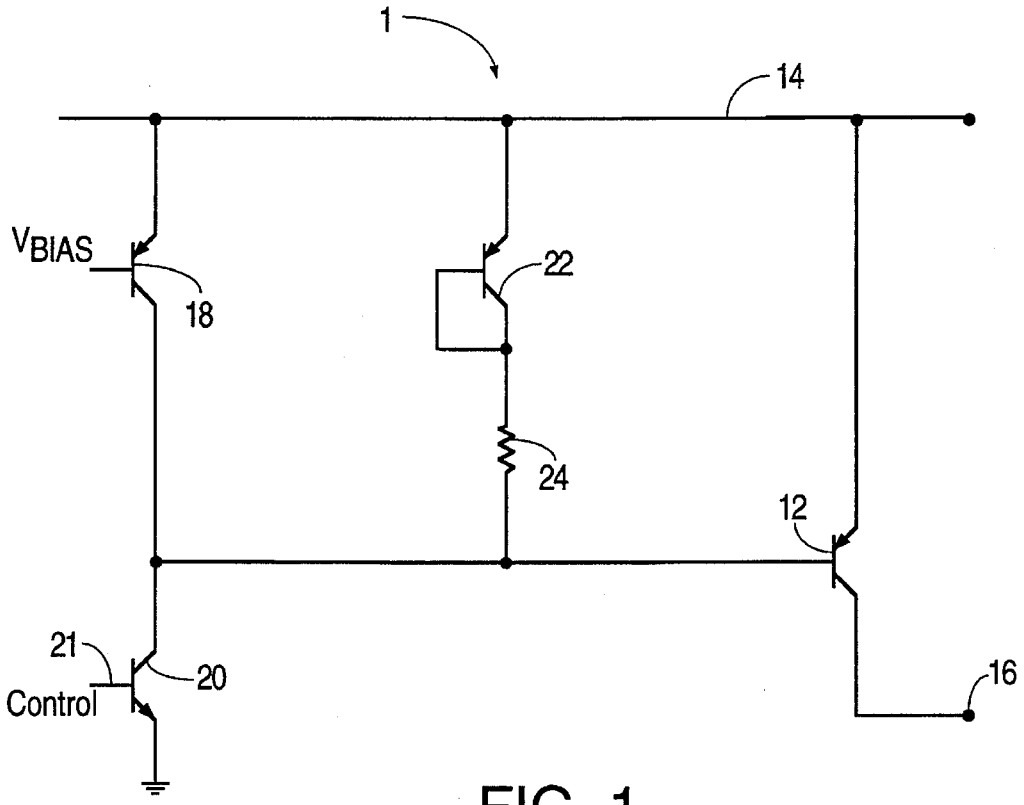
FIG. 1 (prior art)
FIG. 1 is a schematic diagram of a prior art output driver for a voltage regulator.
Figure 2:
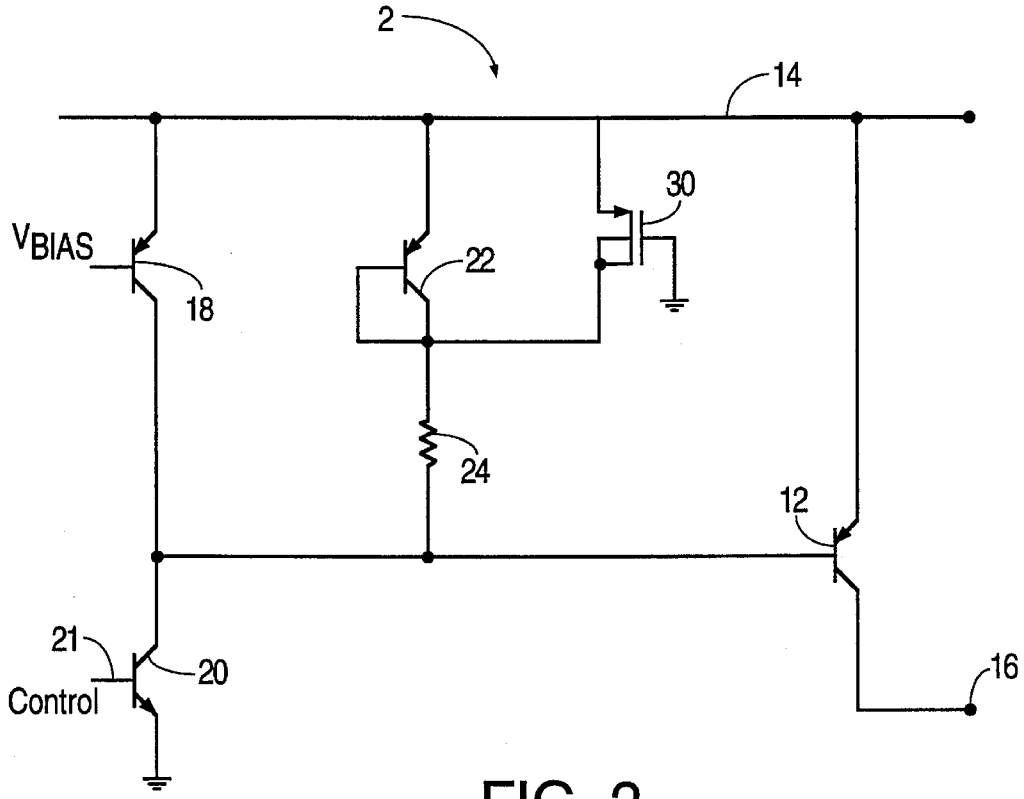
FIG. 2 is a schematic diagram of an output driver in accordance with the present invention.

FIG. 2 shows an output driver 2 as part of a voltage regulator in accordance with one embodiment of the present invention. Those components depicted in FIG. 2 which are similar to and operate in the same manner as components in the prior art output driver of FIG. 1 are appropriately labelled with the same numerals. A suitable feedback circuit may be connected for detecting the output voltage and providing a control signal to the base 21 of transistor 20 to maintain the output voltage constant. One such feedback circuit compares the output voltage to a reference voltage and controls the regulator circuit to continually match the output voltage to the reference circuit. Such feedback circuits are well known and will not be described herein.

Referring to FIG. 2, diode 22 and resistor 24 pull up the base of the PNP pass transistor 12 to turn transistor 12 off and also reduce the base input impedance of pass transistor 12, as described earlier. A P-channel MOS transistor 30, coupled in parallel with diode 22, has its source coupled to input rail 14, its drain coupled to the cathode of diode 22 and to the body of MOS transistor 30, and its gate coupled to ground potential. Preferably, MOS transistor 30 is a P-channel enhancement type MOS device, and diode 22 is a diode-connected lateral PNP transistor. Note, however, that N-type devices (including pass transistor 12) could also be used with simple changes in the circuit. Making such modifications would be within the skill of those in the art.

As mentioned earlier, diode 22 and resistor 24 are insufficient in pulling up the base of pass transistor 12 at high temperatures and input voltages. In particular, as the temperature and input voltage increase, base-substrate and base-emitter leakage currents in pass transistor 12 increase, causing transistor 12 to conduct more current than intended. Even at room temperature, these leakage currents reach levels too large for diode 22 to offset when the input voltage on rail 14 increases beyond approximately 10 volts.

MOS transistor 30 preferably has a threshold voltage equal to approximately 10 volts so that MOS transistor 30 turns on when pull-off diode 22 can no longer offset the base drive resulting from increasing leakage currents. By quickly increasing the current through resistor 24, MOS transistor 30 is able to pull-up the base of transistor 12 fast and conduct enough current to keep pass transistor 12 turned off. Forcing transistor 12 to remain off in such manner thereby reduces (or prevents) leakage currents into the base of transistor 12 and also reduces the collector current and collector voltage. As the input voltage increases further, MOS transistor 30 is made more conductive and assumes from diode 22 more and more of the role of drawing pull-up current through resistor 24.

Further, the addition of MOS transistor 30 in parallel with diode 22 provides a parallel current path between resistor 24 and input rail 14 at high input voltages and, therefore, reduces the base input impedance of transistor 12 at high input voltages. As discussed earlier, a lower base input impedance is advantageous since it reduces any influence transistor 12's parasitic low pass filter has upon output driver 2's frequency response and, therefore, improves circuit stability. It is worth noting that MOS transistor 30 does not increase the ground current during pass transistor 12's off state.

Figure 3:
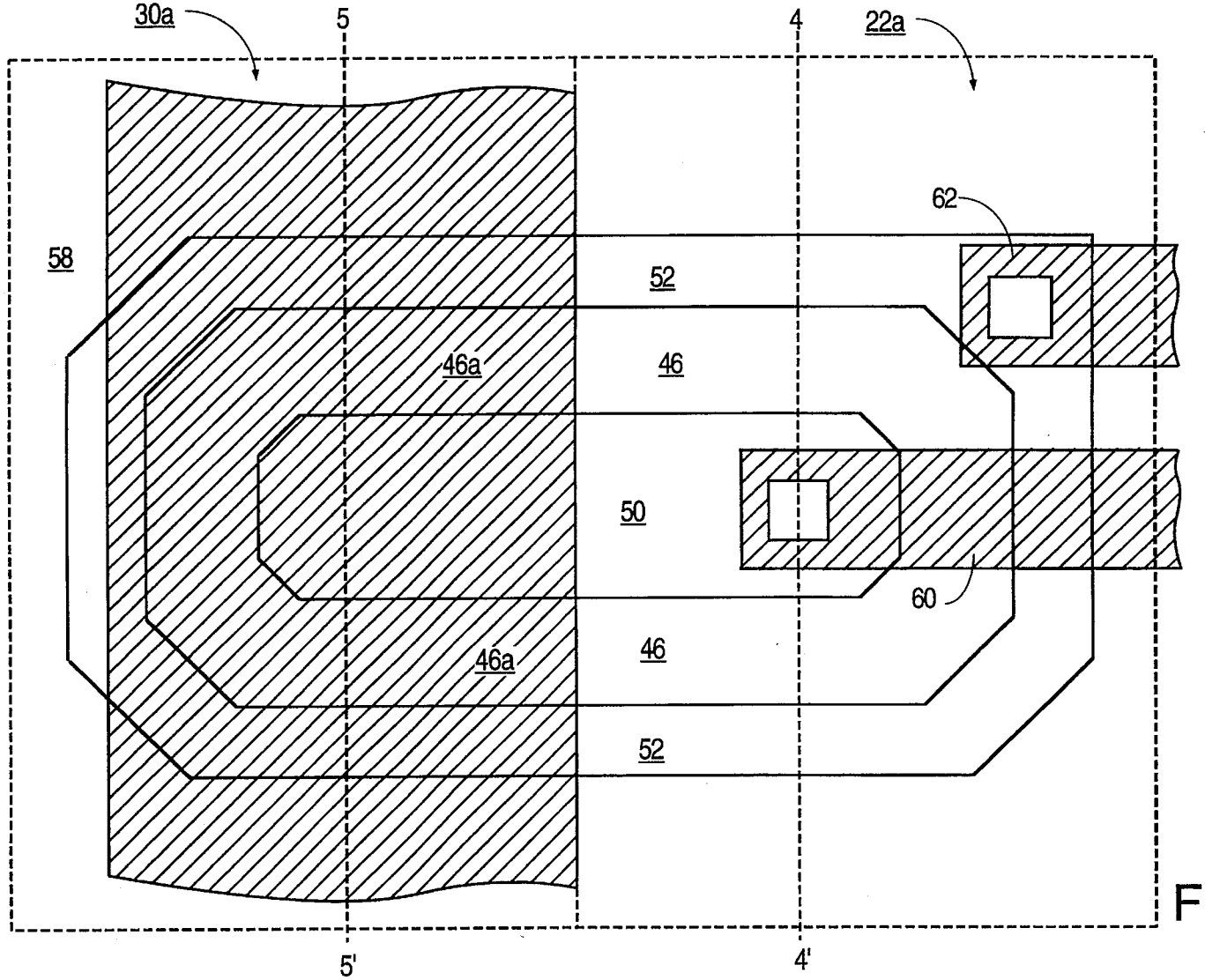
FIG. 3 is a top view of a semiconductor device in accordance with one embodiment of the present invention.

In one embodiment, a P-channel MOS transistor **30*a* (FIG. 3) is formed in an unadjusted field region of PNP diode-connected transistor 22*a*. FIG. 3 is a top view of a semiconductor device 40 which includes a lateral PNP transistor 22*a*, of which a portion operates as P-channel MOS transistor 30*a***.

Figure 4:
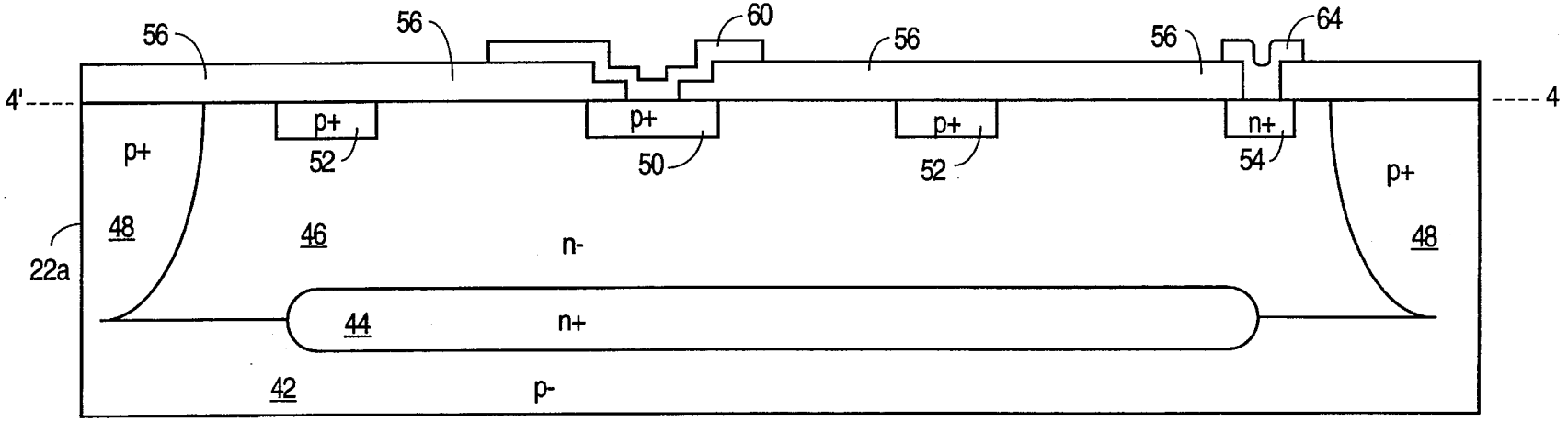
FIG. 4 is a cross-sectional view of the embodiment of FIG. 3 taken along line 4—4'.
Figure 5:
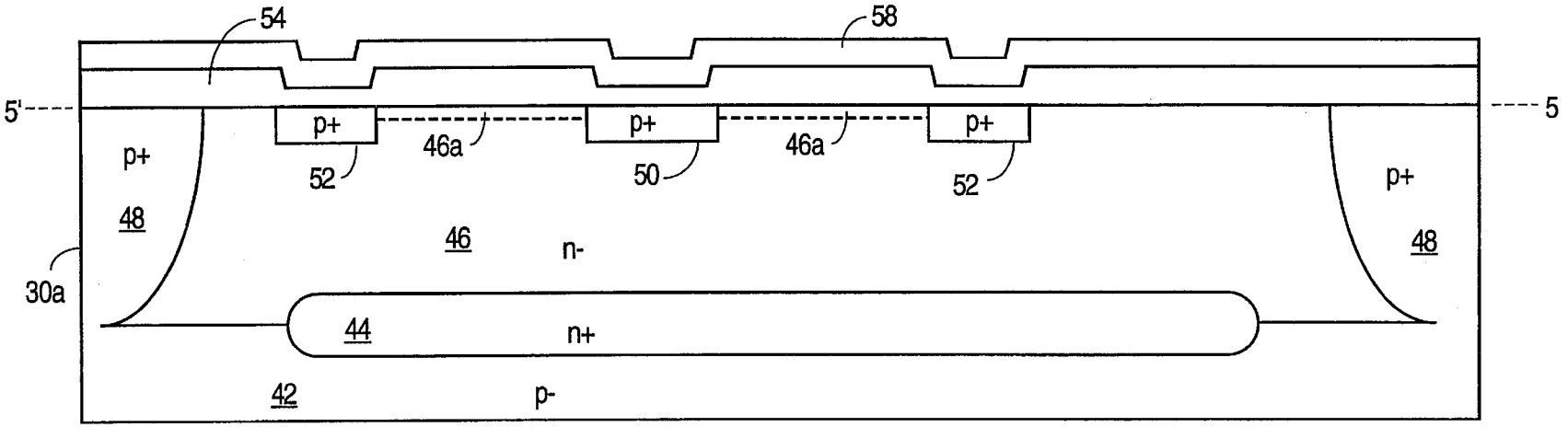
FIG. 5 is a cross-sectional view of the embodiment of FIG. 3 taken along line 5—5'.

FIG. 4 is taken along line 4—4' in FIG. 3, and FIG. 5 is taken along line 5—5' in FIG. 3. Referring also to FIGS. 3, 4, and 5, lateral PNP transistor **22*a* is formed on a P– semiconductor substrate 42 using conventional techniques well known in the art. An N+ buried layer 44 is formed in a portion of the top surface of substrate 42**.

An N– epitaxial layer 46, which serves as the base region of PNP transistor **22*a* and as the body region of MOS transistor 30*a*, is grown on substrate 42. P+ dopants are then introduced into layer 46 to form P+ field regions 48. A P+ emitter/source region 50 and a P+ collector/drain region 52 are then formed in the top surface of layer 46 using conventional techniques. An N+ base contact 54 (not shown in FIG. 3 for simplicity) is then formed in layer 46**. Impurities may be introduced using implantation or other means.

A layer of oxide 56 is then provided over the top surface of the structure and then selectively etched.

Using a single masking step, a layer of metal (or any other suitable conducting material, such as doped polysilicon) is deposited over the surface of oxide 56 and then selectively etched. The exposed portions of the metal are then removed, leaving gate metal 58, emitter/source metal 60, collector/drain metal 62, and base contact metal 64 (not shown in FIG. 3 for simplicity). If the structure of FIGS. 3–5 were used in the circuit shown in FIG. 2, the metal etch would leave a metal connection between base contact 54 and collector/drain region 52. The operation of the embodiment of FIGS. 3–5 will be described below.

Referring to FIGS. 3 and 4, the entirety of device 40 operates in a manner identical to that of a conventional lateral PNP transistor when the potential difference between gate metal 58 and emitter/source metal 60 is less than a threshold voltage. Thus, the application of a potential difference of approximately 0.7 volts between emitter/source metal 60 and base contact metal 64 (FIG. 4), and proper collector metal biasing, cause the PNP transistor to conduct current between its emitter and collector. The resultant current flow from emitter/source region 50 to collector/drain region 52 is consistent with well known PNP voltage-current characteristics.

When, however, a potential difference exceeding the aforementioned threshold voltage is applied between gate metal 58 and emitter/source metal 60, those portions of device 40 substantially underlying gate 58, which comprise MOS transistor 30*a*, operate in a manner consistent with conventional P-channel MOS transistors (see FIG. 3). As the voltage applied between gate metal 58 and emitter/source metal 60 exceeds the threshold voltage, a channel region 46*a* is created along the surface of layer 46 underlying gate metal 58. Referring to FIGS. 3 and 5, current begins to flow from emitter/source region 50 to collector/drain region 52 via channel region 46*a*. Note that those portions of device 40 comprising PNP transistor 22*a* which do not substantially underlie gate 58 continue to operate as described above notwithstanding the application of a threshold voltage between gate metal 58 and emitter/source metal 60.

The above described embodiment, by integrating an MOS transistor into the unadjusted field of a PNP transistor, is advantageous since no additional semiconductor surface area is required to add an MOS transistor in parallel with a lateral PNP transistor. Equally important is that the present embodiment requires no additional masking or process steps to fabricate. The MOS transistor uses emitter and collector regions of the PNP as source and drain regions, respectively, and the gate metal may be formed simultaneously with the emitter, collector, and base metal using a single mask. Thus, the present invention may be implemented to improve the performance of a voltage regulator at a minimal cost. The conductivity types may be reversed to form an NPN transistor integral with an N-channel MOS transistor.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An output circuit comprising:

a bipolar output transistor, said output transistor having a base coupled to a base drive terminal, a first current handling terminal connected to a first voltage, and a second current handling terminal coupled to an output terminal of said output circuit for providing an output voltage and an output current;

a serial connection of a resistor and a diode connected between said base of said output transistor and said first voltage; and an MOS transistor connected in parallel with said diode, said MOS transistor having a gate coupled to a second voltage, wherein said MOS transistor turns on when said first voltage equals a predetermined voltage to pull said base of said output transistor towards said first voltage sufficient to cause said output transistor to be in an off state.

2. The structure of claim 1 wherein said predetermined voltage is approximately 10 volts.

3. The structure of claim 1 wherein said diode further comprises a diode-connected transistor having a base, an emitter, and a collector, said emitter being coupled to said first voltage, said collector being coupled to said base and to a terminal of said resistor.

4. The structure of claim 3, said MOS transistor having a source coupled to said first voltage and a drain coupled to said collector of said diode-connected transistor.

5. The structure of claim 4 wherein said diode-connected transistor comprises a lateral PNP transistor.

6. The structure of claim 5 wherein said MOS transistor comprises a P-channel enhancement type MOS transistor.

7. The structure of claim 6 wherein said second voltage equals approximately zero.

8. The structure of claim 4 wherein said diode-transistor comprises an NPN transistor and said MOS transistor is an n-channel device.

9. The structure of claim 6 wherein said MOS transistor is incorporated entirely within a field region of said lateral PNP transistor, wherein portions of said collector and said emitter of said lateral PNP transistor correspond to said source and said drain regions of said MOS transistor, respectively, and a portion of said base of said lateral PNP transistor corresponds to a channel region of said MOS transistor.

10. A semiconductor device comprising:

an emitter region having first and second portions of a first conductivity type;

a body region having first and second portions of a second conductivity type;

a collector region having first and second portions of said first conductivity type;

a base terminal coupled to said body region; and a gate overlying said first portions of said emitter, said body, and said collector regions, wherein application of a voltage greater than a threshold voltage induces a channel region located in said first portion of said body region, said channel region extending between said first portion of said emitter region and said first portion of said collector region, said first portion of said emitter region serving as a source, said first region of said collector serving as a drain.

11. The structure of claim 10 wherein said first conductivity type is N-type and said second conductivity type is P-type.

12. The structure of claim 10 wherein said first conductivity type is P-type and said second conductivity type is N-type.

13. The structure of claim 12 wherein said semiconductor device comprises a lateral PNP transistor.

14. The structure of claim 13 wherein said emitter region is disposed within and laterally surrounded by said body region and wherein said collector region is disposed within said body region and laterally surrounds said emitter region.

15. The structure of claim 14 further comprising:

a first conductive path coupled to said base terminal;

a second conductive path coupled to said collector region; and an third conductive path coupled to said emitter region, wherein said gate and said first, second, and third conductive paths are simultaneously formed on a top surface of said semiconductor device.

16. The structure of claim 15 wherein said gate and said first, second, and third conductive paths are polysilicon.

17. The structure of claim 16 wherein said threshold voltage equals approximately 10 volts.

* * * * *